US005460565A

United States Patent [19]

Perneczky

[11] Patent Number: 5,460,565

[45] Date of Patent: Oct. 24, 1995

[54] PIVOTING POLISHING BLOCK FOR USE IN APPARATUS FOR CLEANING AND POLISHING ROLL ASSEMBLIES

[76] Inventor: George C. Perneczky, 8918 Biloba, Orland Park, Ill. 60462

[21] Appl. No.: 215,999

[22] Filed: Mar. 22, 1994

Related U.S. Application Data

[63] Continuation of Ser. No. 917,865, Jul. 21, 1992, abandoned.

[51] Int. Cl.[6] ..... B24B 5/37

[52] U.S. Cl. ..... 451/162; 451/172; 451/540; 451/426

[58] Field of Search ..... 451/162, 164, 451/166, 173, 108, 49, 424, 426, 540

[56] References Cited

U.S. PATENT DOCUMENTS 2,717,422 9/1955 Rowe et al. .
3,146,552 9/1964 Croshaw et al. .
3,739,534 6/1973 Fuller .
4,206,574 6/1980 Dotsko .
4,535,574 8/1985 Dettelbach et al. .
4,887,329 12/1989 Perneczky .
5,060,423 10/1991 Klotz .

*Primary Examiner*—Maurina T. Rachuba
*Attorney, Agent, or Firm*—Keck, Mahin & Cate

[57] ABSTRACT

A pivoting polishing block assembly comprises a torsion arm having a molded polishing block joined thereto in pivoting relation about the central axis of the torsion arm. The molded polishing block comprises a polishing block holder having a plurality of openings formed therein, and an abrasive pad formed thereover composed of an abrasive, moldable material. An apparatus for cleaning and polishing rolls, which includes the pivoting polishing block assembly, is also provided.

24 Claims, 5 Drawing Sheets

PIVOTING POLISHING BLOCK FOR USE IN APPARATUS FOR CLEANING AND POLISHING ROLL ASSEMBLIES

CROSS-REFERENCE TO RELATED APPLICATION

This application is a continuation of application Ser. No. 07/917,865, filed Jul. 21, 1992, now abandoned.

BACKGROUND OF THE INVENTION

1. Field of the Invention

The present invention relates generally to an adjustable apparatus for cleaning and polishing rolls used to roll sheet stock, such as sheet steel, sheet plastic, paper, and the like. In particular, the invention pertains to a roll assembly cleaning and polishing device having a pivoting polishing block of improved durability, which also minimizes uneven wear of both the polishing block and the roll.

2. Description of the Prior Art

Sheet stock, such as steel, plastic, aluminum, and paper, is generally fed through a series of rolls, such as guide rolls and wringer rolls, as part of the manufacturing process. Such rolls provide contact with the sheet stock for a variety of purposes, such as to guide or dry the sheet stock either before or after a coating process, as it is being cut to width, or as it is wound into large coils for ease of handling, storage, and transportation. The surfaces of such rolls have a tendency to accumulate abrasive contaminants, corrosive coatings, and particles of sheet stock on their surfaces, which can seriously mar and damage the surface of the sheet stock. Furthermore, such accumulations on the roll surfaces may embed themselves in the roll surfaces, scar the roll surfaces, or otherwise seriously damage them. It is therefore desirable to clean the surfaces of the rolls to prevent such accumulations from damaging both the sheet stock and the rolls themselves.

Although it is possible to shut down a manufacturing operation periodically to replace the rolls with fresh ones that have been cleaned, or to clean manually the rolls in service, it is generally uneconomic to do so, because the down-time involved to stop and start the manufacturing operation is excessive.

Consequently, a roll cleaning apparatus which functions during the manufacturing process is preferred. One such cleaning system is described in Applicant's U.S. Pat. No. 4,528,716, which relates to a roll cleaning device utilizing a knife-edge blade arrangement to clean the surface of roll assemblies. However, this device does not provide a mechanism for polishing the rolls, nor does it provide a means for oscillating the blade arrangement across the surface of the roll.

An early attempt to provide a roll cleaning and polishing device employed a series of polishing blocks arranged on a polishing block support assembly in a tandem block arrangement having a total combined width at least as wide as the roll surface, and mounted tandem to a lever operated engagement system so that the operation of the lever engages the polishing blocks over the entire width of the roll surface. The polishing blocks are each resiliently mounted so that they provide substantially the same surface pressure within a wide range of variation of polishing block wear between the individual polishing blocks. This system is not entirely satisfactory, however, because the stationary polishing blocks so used have a tendency to leave a scarring pattern of their own on the roll.

An improved roll cleaning apparatus is described in Applicant's U.S. Pat. No. 4,841,675. This patent discloses a device which automatically engages and oscillates a tandem arrangement of polishing blocks on the roll surface. The oscillating motion of the blocks laterally scrub the roll surfaces as they polish to prevent the development of any polishing block scarring pattern. The oscillating movement is provided by a pneumatically actuated positioning cylinder at one end of the tandem polishing block arrangement on its polishing block support assembly and a hydraulically operated dampening cylinder at the other end. Each of the cylinders is individually supported in position with its own pneumatic support assembly. This arrangement provides automatic alignment of the polishing block support assembly with the roll surface at a regulated pressure. Further, separate cylinders for each end of the polishing block support assembly prevent bearing misalignment problems.

Although this apparatus is quite satisfactory from the standpoint of performance, it is bulky, complex and expensive. Accordingly, Applicant provided a further improved apparatus, disclosed in U.S. Pat. No. 4,887,329, which utilizes a support assembly that is retained by self aligning bearings, in order to permit reciprocal actuation by a single linear actuator coupled to one of the ends of the support assembly. The device therefore enables a simple, single end actuation of the polishing blocks, by means of a lever or counterweights, depending on whether temporary or continuous engagement of the polishing action is desired.

Despite the foregoing efforts, certain difficulties continue to be encountered in the operation of roll cleaning and polishing devices. For example, polishing blocks have conventionally been bonded to their block mounting surface brackets by adhesive bonding, using a high strength glue or epoxy resin. Upon exposure to certain chemical environments, the bonding material sometimes fails, causing the polishing block to fall off its mounting bracket. In some cases, the rolls present a pinch point where, for example, a steel strip is translated across the roll and snubbed to this roll by means of a snubber roll. If a dislodged polishing block travels across the roll in the direction of the pinch point, it may be pulled through the rolls and/or the strip. Consequently, in the case of electrogalvanize line conductor rolls, if the strip is temporarily separated from the conductor roll by the polishing block, arcing will occur, resulting in damage to or destruction of the conductor roll.

Another problem characteristic of conventional roll cleaning and polishing devices relates to the difficulty of properly aligning the bank of polishing blocks in horizontal relation to the roll. In this regard, polishing blocks have conventionally been rigidly mounted to the end of a torsion arm. It has therefore been necessary to accurately hold individual polishing blocks in a horizontal plane while tightening a bolt to secure the polishing block. This task is difficult to perform correctly, since the resilient joint of the torsion arm does not rigidly support the torsion arm while the bolt is being tightened. As a result, installed polishing blocks are commonly slightly out of horizontal alignment. Thus, upon displacement of the torsion spring shaft during operation of the cleaning/polishing device, the forces applied by the polishing block to the face of the roll are not uniform.

Consequently, non-uniform contact causes the blocks to wear unevenly, and sometimes to wear the roll surface unevenly, which imparts undesired hills and valleys in the roll profile. In the case of electrogalvanize line conductor rolls, altering the roll profile prevents the strip from following the contour of the roll, thereby introducing air pockets between the strip and the roll. Such air pockets become the source of arcing, which as noted previously can damage or destroy a conductor roll.

It would therefore be desirable to provide an apparatus for cleaning and polishing roll assemblies which overcomes the aforementioned difficulties of the prior art.

SUMMARY OF THE INVENTION

In order to obviate the failure of adhesively bonded polishing blocks, the invention provides a molded polishing block for cleaning and polishing the surface of a cylindrical roll, which comprises an abrasive pad composed of a moldable, abrasive material, and support means for supporting the abrasive pad, wherein the abrasive pad is molded around the support means to secure the abrasive pad to the support means.

The molded polishing block includes an abrasive pad that is composed of any suitable abrasive, moldable material, such as plastics, metals and alloys. The abrasive pad may include additional abrasive materials, such as sand, ground minerals, such as silicon, silicon carbide, aluminum oxide, and the like.

The support means preferably comprises a metallic polishing block holder having a plurality of openings formed therein, such that a portion of the moldable material of the abrasive pad bonds the abrasive pad to the metallic polishing block holder through the openings.

To obviate the problem of non-aligned polishing blocks, the invention also contemplates a pivoting polishing block assembly for cleaning and polishing the surface of a cylindrical roll, which comprises:

(a) a molded polishing block comprising:

(i) an abrasive pad composed of a moldable, abrasive material; and (ii) support means for supporting the abrasive pad, wherein the abrasive pad is molded around the support means to secure the abrasive pad to the support means; and (b) a torsion arm joined to the support means, wherein the molded polishing block is pivotable about a central axis of the torsion arm.

The torsion arm preferably includes a shaped end joined to the support means, which limits the rotation of the polishing block about the central axis of the torsion arm; the torsion arm also preferably includes a resilient material disposed within the opposite end thereof through which a shaft, such as the shaft of a bolt, passes to provide for resilient rotational movement around the central axis of the shaft.

The pivoting polishing block assembly preferably includes an abrasive pad formed of an abrasive moldable material selected from the group consisting of plastics, metals, and alloys.

Another aspect of the invention relates to an apparatus for cleaning and polishing the surface of a cylindrical roll, which comprises:

(1) at least one pivoting polishing block assembly comprising:

(a) a molded polishing block comprising:

(i) an abrasive pad composed of a moldable, abrasive material; and (ii) support means for supporting the abrasive pad, wherein the abrasive pad is molded around the support means to secure the abrasive pad to the support means; and (b) a torsion arm joined to the support means, wherein the molded polishing block is pivotable about a central axis of the torsion arm and the torsion arm itself is resiliently rotatable about an axis perpendicular to the central axis of the torsion arm;

(2) means for positioning the pivoting polishing block assembly over a surface of a cylindrical roll; and (3) means for reciprocally scrubbing the surface of the roll with the pivoting polishing block assembly, by actuating the pivoting polishing block assembly in a direction perpendicular to a direction of travel of the roll.

The at least one pivoting polishing block assembly preferably comprises a plurality of pivoting polishing block assemblies in tandem arrangement.

The cleaning and polishing apparatus preferably includes an abrasive pad composed of a moldable material selected from the group consisting of plastics, metals, and alloys. Further, the support means preferably comprises a metallic polishing block holder having a plurality of openings formed therein, such that a portion of the moldable material of the abrasive pad bonds the abrasive pad to the metallic polishing block holder through the openings.

The torsion arm utilized in the inventive apparatus preferably includes a rectangular-shaped end joined to the support means, which limits the rotation of the polishing block about the central axis of the torsion arm; the torsion arm also preferably includes a resilient material disposed within the opposite end thereof through which a shaft, such as the shaft of a bolt, passes to provide resilient rotational movement around the central axis of the shaft.

DESCRIPTION OF THE PREFERRED EMBODIMENTS

Figure 1:
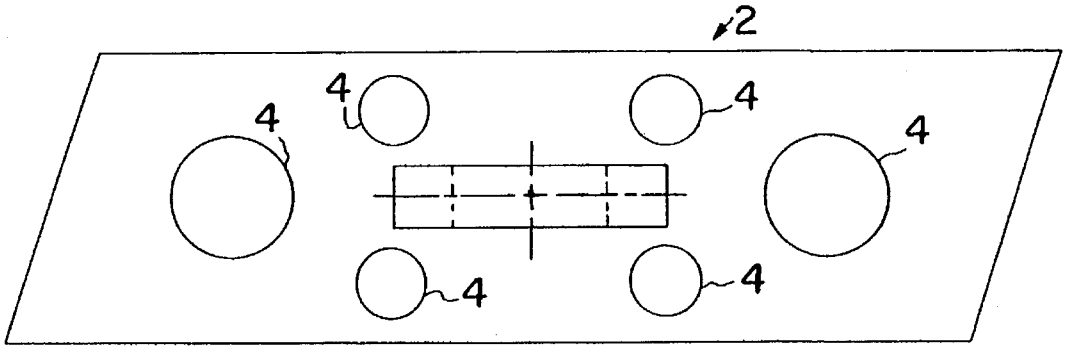
FIG. 1 a top view of the polishing block holder 2.
Figure 2:
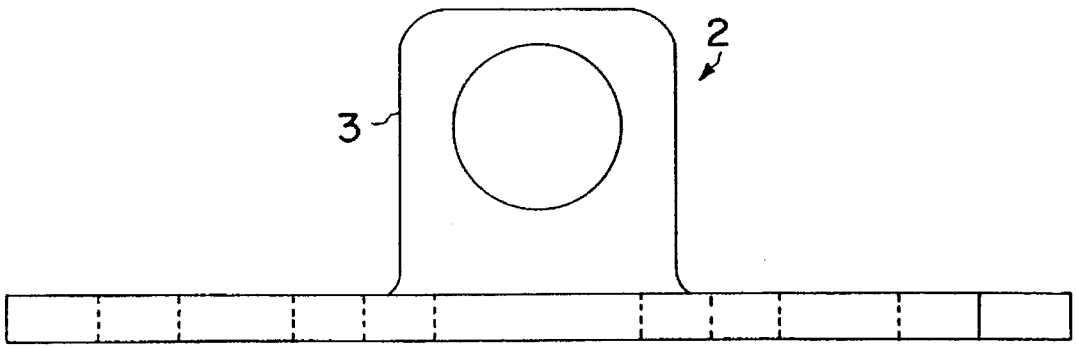
FIG. 2 is a side view of the polishing block holder 2 shown in FIG. 2.
Figure 3:
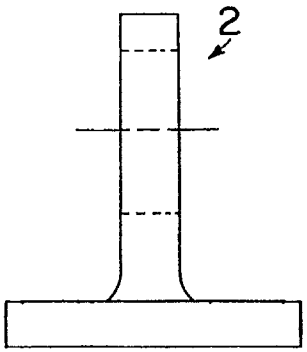
FIG. 3 is an end view of the polishing block holder 2 shown in FIG. 2.
Figure 4:
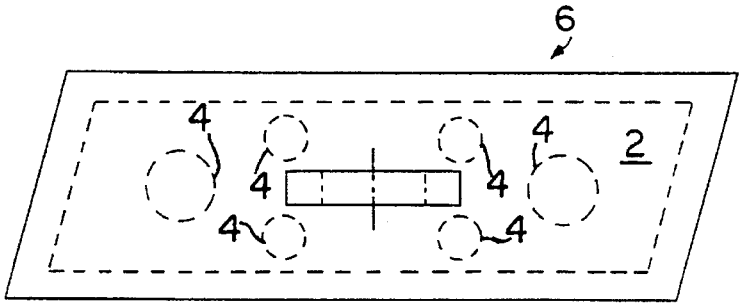
FIG. 4 is a top view of the molded polishing block 6.
Figure 5:
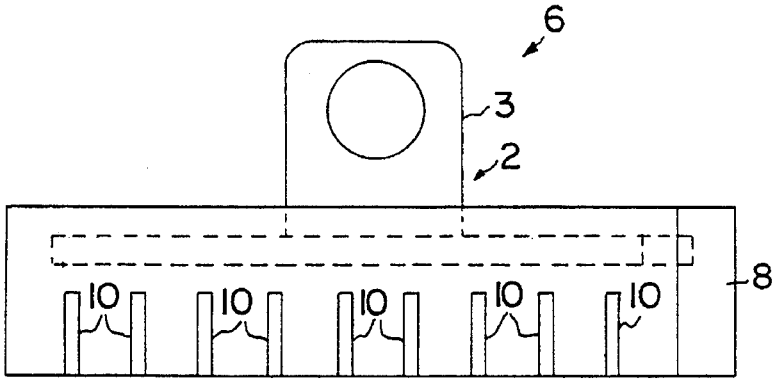
FIG. 5 is a side view of the molded polishing block 6 shown in FIG. 4.

Referring to the drawings, wherein the same reference characters designate like or corresponding parts throughout the views, FIGS. 1, 2, and 3 show different views of the polishing block holder 2 provided by the invention. The polishing block holder 2, also known as a block mounting surface bracket, comprises a metal plate, preferably formed of steel, having a plurality of openings 4 formed on the surface thereof, to facilitate molding of the polishing block holder 2 to an abrasive pad. The polishing block holder 2 includes a vertical tang 3 having a precision bore formed therethrough for pivoting engagement with a torsion arm, as described in further detail below.

FIGS. 4–7 show various perspectives of a molded polishing block 6 as provided by the invention. Applicant has discovered that by molding an abrasive, moldable material to a polishing block holder 2 as depicted in FIGS. 1–3, a molded polishing block 6 may be provided which exhibits characteristics of improved durability and chemical resistance under a variety of operating conditions.

The molded polishing block 6 includes an abrasive pad 8 that is composed of any suitable abrasive, moldable material, such as plastics, metals, and alloys. If desired, the abrasive pad 8 may contain a variety of known substances to render it abrasive, such as sand, ground minerals, such as silicon, silicon carbide, aluminum oxide, and the like. The abrasive pad 8 preferably has a plurality of grooves 10 formed on the bottom surface thereof, to facilitate the removal of particulate waste from the roll during the cleaning and polishing operation.

Figure 6:
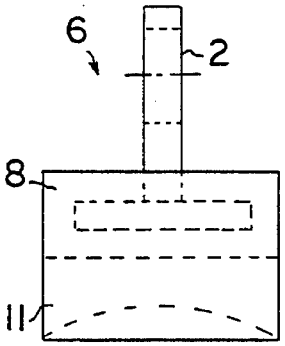
FIG. 6 is an end view of the molded polishing block 6 shown in FIG. 4.
Figure 7:
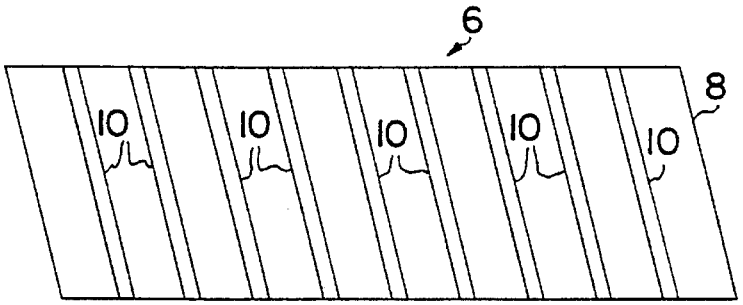
FIG. 7 is a bottom view of the molded polishing block 6 shown in FIG. 4.

The molded polishing block 6 is formed by molding the abrasive, moldable material onto the polishing block holder 2, using conventional molding technology and equipment known in the art. For example, the preformed polishing block holder 2 can be placed into a mold, and moldable, abrasive material which has been heated to a suitable temperature to render the material flowable, can be poured into the mold until the plate-like portion of the polishing block holder 2 is covered with the moldable, abrasive material. The material is then permitted to cool and solidify, such that a solid, molded abrasive pad 8 is formed over and around the polishing block holder 2. The grooves 10 in the bottom of the abrasive pad 8 can be cut out after formation of the abrasive pad 8, or they can be formed by the shape of the mold itself. The bottom of the pad 8 may be squared off, as shown in FIG. 6 or may be arcuate in shape, as shown by phantom lines 11 in FIG. 6, the latter configuration providing increased surface area for contact with the roll being cleaned.

Figure 8:
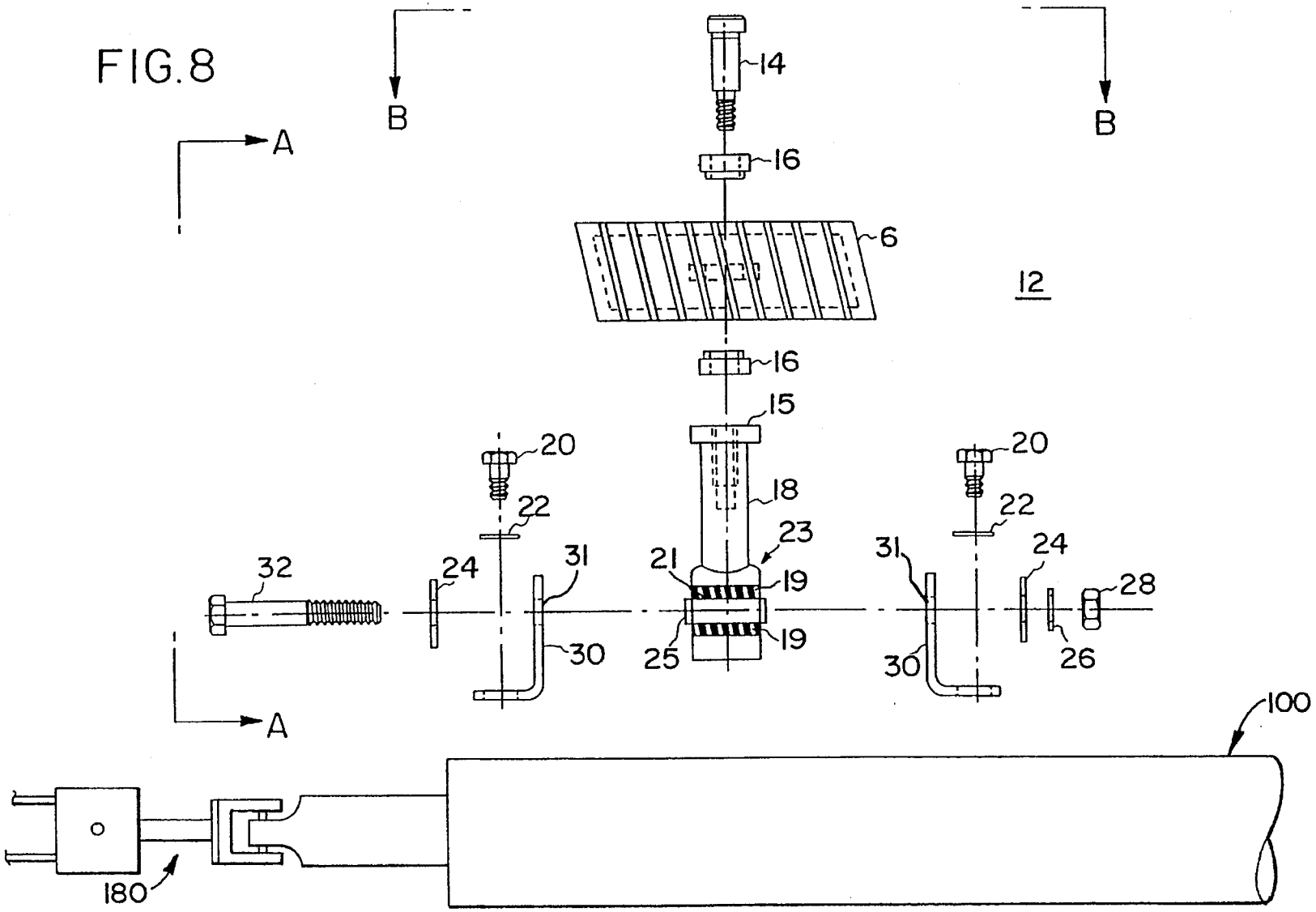
FIG. 8 is an exploded view of the pivoting polishing block assembly 12 and associated support mechanism provided by the invention.
Figure 9:
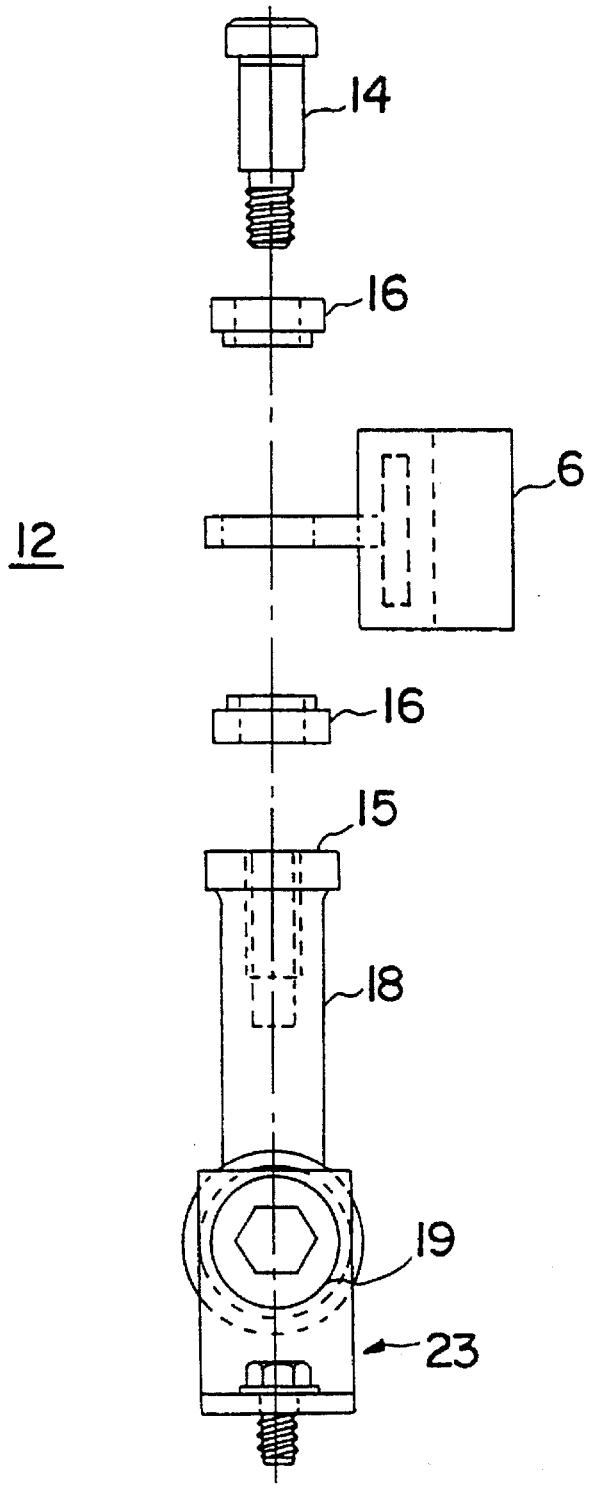
FIG. 9 is an exploded view of the pivoting polishing block assembly 12 taken along the lines A—A of FIG. 8.
Figure 10:
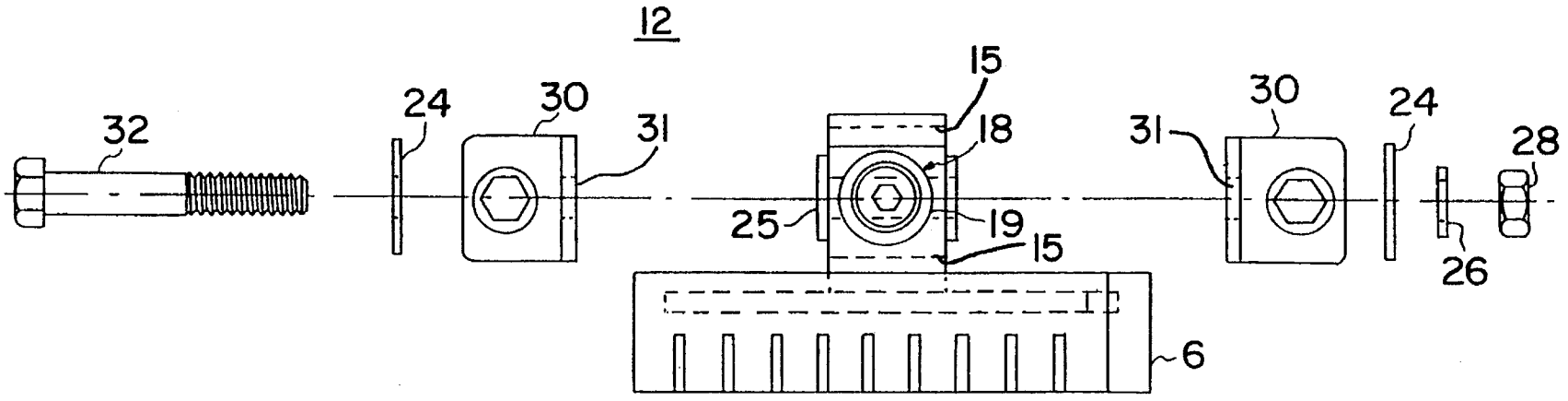
FIG. 10 is an exploded view of the pivoting polishing block assembly 12 taken along the lines B—B of FIG. 8.

FIGS. 8–10 illustrate the second aspect of the invention, namely, the pivoting polishing block assembly 12 which allows a polishing block to be accurately positioned in proper horizontal relation with respect to the surface of a roll to be cleaned and polished.

To form the pivoting polishing block assembly 12, the end 15 of a torsion arm 18 is faced off, drilled, and tapped. Two bushings 16 are inserted through the bore of the vertical tang 3 of the polishing block holder 2, and a shoulder bolt 14 is inserted through the bushings. The shoulder bolt 14 is then firmly tightened against the faced-off end 15 of the torsion arm 18.

In use, the polishing block/torsion arm is secured to an appropriate mounting structure which is capable of orienting the polishing block over the surface of a roll, and preferably also providing reciprocal motion to the polishing block in a direction perpendicular to the direction of travel of the roll. In this regard, the torsion arm 18 is preferably anchored to a mounting structure by means of support element brackets 30, via hexagonal head bolts (20, 32), flatwashers (22, 24), split lockwasher 26, and heavy hexagonal nut 28, as shown in FIGS. 8–10.

The base 23 of the arm 18, opposite faced-off end 15, is provided with a bore in which is firmly attached, as by bonding, to a resilient insert 19. The insert 19 (shown in cross-hatch) is provided with a cylindrical channel 21 through which tube 25 extends. The tube 25 may be made from any convenient metal, such as stainless steel and the like. The outer surface of the tube 25 is firmly attached, as by bonding, to the surface of the cylindrical channel 21. In use, the shaft of the bolt 32 passes through aligned cut-out regions 31 of the brackets 30 and the tube 25 and each bracket 30 is tightened against the respective ends of the tube 25. As shown in FIGS. 8 and 10, the ends of the tube 25 extend beyond the perimeter of the base 23; the support brackets 30 engage these ends. Because the insert 19 is firmly attached both to the base 23 and the tube 25, the insert 19 acts to provide torsional rotation around its central axis (which, as shown, corresponds to the central axis of the bolt 32). Thus, when the arm 18 is attached to the brackets 30, torsional rotation of the arm, about the central axis of the bolt 32, may occur when the assembly 12 is in use. This provides the added advantage of allowing the block 6 to "ride over" uneven surfaces of the surface of the roll being cleaned.

The polishing block assembly 12 preferably utilizes a molded polishing block 6 as described in detail above.

The polishing block assembly 12 allows the molded polishing block 6 to pivot about the centerline of the shoulder bolt 14 and torsion arm 18. This structure assures horizontal positioning of the polishing block 6, and even contact between the abrasive pad 8 and the surface of a roll during operation of a cleaning and polishing device including the polishing block assembly 12.

The pivoting motion of the molded polishing block 6 is limited by the rectangular shape of the end 15 of the torsion arm 18. The pivoting motion is limited so that the molded polishing block 6 cannot over-rotate about its axis due to gravitational forces when the polishing block is installed. Limiting the pivoting motion of the polishing block 6 is advantageous, in that complete rotation of the polishing block might result in contact between the vertical tang 3 and the surface of the roll, which would cause scarring of the roll.

The molded polishing block 6 and the polishing block assembly 12 of the invention may be incorporated into devices for cleaning and polishing rolls known to those of ordinary skill in the art. For example, and as shown in FIG. 8, the molded polishing block 6 and polishing block assembly 12 may be mounted on a support assembly 100 for positioning an exposed surface of the polishing block 6 in contact with the surface of a cylindrical roll (not shown), as described in U.S. Pat. No. 4,887,329. By reciprocally driving the support assembly 100 using a linear actuator 180 similar to that disclosed in U.S. Pat. No. 4,887,329, the polishing block thus will reciprocally scrub the surface of the cylindrical roll. Specifically, the support assembly 100 shown in FIG. 8 corresponds to support assembly 10 of U.S. Pat. No. 4,887,329, and linear actuator 180 corresponds to linear actuator 18 of U.S. Pat. No. 4,887,329. In this respect, Applicant incorporates herein by reference the entire disclosures of his prior U.S. Pat. Nos. 4,528,716, 4,841,675, and 4,887,329, which disclosures will exemplify typical roll cleaning/polishing systems in which the apparatus of the invention may be utilized.

Thus, the pivoting polishing block of the invention may be substituted for conventional polishing block assemblies, without substantial modification of the cleaning and polishing devices. The inventive pivoting polishing block structure has been found to work equally well in systems which employ single ended actuation using levers or counterweights, and hydraulic or pneumatic driven actuating systems. The inventive device exhibits improved durability and extended useful life in chemical environments. In addition, the pivoting polishing block imparts self-adjusting, even forces to the surface of the treated roll, which results in reduced roll and polishing block wear.

It will be understood that various changes in the details, arrangements, and configurations of parts of the inventive apparatus may be made by those skilled in the art within the principle and scope of the invention as expressed in the appended claims.

What is claimed is:

1. A pivotable polishing block assembly providing two degrees of rotational freedom for use with an apparatus for cleaning and polishing a peripheral surface of a cylindrical roll rotating about the longitudinal axis of the roll, the assembly comprising:

(a) a molded polishing block including an elongated abrasive pad support having a top surface, a bottom surface, opposed ends and opposed sides, a tang positioned on said top surface, said tang including a cut-out region adapted to receive a first rotatable bushing on one side of said tang and a second rotatable bushing on the other side of said tang, an abrasive pad located along said bottom surface, said abrasive pad composed of a moldable, abrasive material and including an exposed surface of the moldable, abrasive material for cleaning and polishing the peripheral surface of the cylindrical roll, said support having a plurality of openings communicating through said top surface and said bottom surface for receipt of a portion of said moldable, abrasive material thereby firmly attaching said abrasive pad to said support, said top surface, bottom surface, opposed ends and opposed sides of said elongated abrasive pad support being embedded in said moldable, abrasive material with said tang extending therefrom;

(b) an elongated arm having a first end and a second end region, said first end being adapted to matingly engage one end of a first shaft positioned through said first bushing, said cut-out region of said tang and said second bushing thereby holding said first bushing in contact with said first end and said tang and the other end of said first shaft having a head portion to hold said second bushing in contact with said tang whereby said bushings permit said block to rotate in a plane perpendicular to aligned longitudinal axes of said first shaft and said arm as the pivotable polishing block assembly is used during the cleaning and polishing of the rotating cylindrical roll, said second end region of said arm being provided with a bore therethrough, said bore being substantially perpendicular to the longitudinal axis of said arm, said bore including a resilient insert having a generally cylindrically-shaped channel therethrough and a tube extending through said channel and affixed thereto, the ends of said tube extending outwardly beyond the perimeter of said second end region; and (c) mounting brackets having aligned cut-out regions, each of said brackets adjustably and securely engagable with respective ends of said tube whereby said arm is resiliently rotatable around the longitudinal axis of said tube, a second shaft extending through said tube and said aligned cut-out regions, said second shaft adapted for secure engagement with said brackets, said mounting brackets being adapted for mounting to a support associated with the roll cleaning and polishing apparatus.

2. The pivotable polishing block assembly of claim 1, wherein the abrasive pad comprises a moldable material selected from a group consisting of plastics, metals, and alloys.

3. The pivotable polishing block assembly of claim 1, wherein said first end of said elongated arm is of rectangular cross-sectional shape to limit rotation of said block around said aligned longitudinal axes.

4. The pivotable polishing block assembly of claim 1, wherein said abrasive pad includes a plurality of spaced-apart cut-outs, said cut-outs being generally parallel to said opposed ends.

5. The pivotable polishing block assembly of claim 1, wherein the exposed surface of said abrasive pad is arcuate in shape.

6. An apparatus for cleaning and polishing a peripheral surface of a cylindrical roll rotating about the longitudinal axis of the roll, the apparatus comprising:

(a) at least one pivotable polishing block assembly providing two degrees of rotational freedom including (i) a molded polishing block including an elongated abrasive pad support having a top surface, a bottom surface, opposed ends and opposed sides, a tang positioned on said top surface, said tang including a cut-out region adapted to receive a first rotatable bushing on one side of said tang and a second rotatable bushing on the other side of said tang, an abrasive pad located along said bottom surface, said abrasive pad composed of a moldable, abrasive material and including an exposed surface of the moldable, abrasive material for cleaning and polishing the peripheral surface of the cylindrical roll, said support having a plurality of openings communicating through said top surface and said bottom surface for receipt of a portion of said moldable, abrasive material thereby firmly attaching said abrasive pad to said support, said top surface, bottom surface, opposed ends and opposed sides of said elongated abrasive pad support being embedded in said moldable, abrasive material with said tang extending therefrom;

(ii) an elongated arm having a first end and a second end region, said first end being adapted to matingly engage one end of a first shaft positioned through said first bushing, said cut-out region of said tang and said second bushing thereby holding said first bushing in contact with said first end and said tang and the other end of said first shaft having a head portion to hold said second bushing in contact with said tang whereby said bushings permit said block to rotate in a plane perpendicular to aligned longitudinal axes of said first shaft and said arm as said at least one pivoting polishing block assembly is used during the cleaning and polishing of the rotating cylindrical roll, said second end region of said arm being provided with a bore therethrough, said bore being substantially perpendicular to the longitudinal axis of said arm, said bore including a resilient insert having a generally cylindrically-shaped channel therethrough and a tube extending through said channel and affixed thereto, the ends of said tube extending outwardly beyond the perimeter of said second region;

(iii) mounting brackets having aligned cut-out regions, each of said brackets adjustably and securely engagable with respective ends of said tube whereby said arm is resiliently rotatable around the longitudinal axis of said tube, a second shaft extending through said tube and said aligned cut-out regions, said second shaft adapted for secure engagement with said brackets, said mounting brackets being adapted for mounting to a support associated with the roll cleaning and polishing apparatus;

(b) means for positioning said at least one pivotable polishing block assembly in contact with said surface of said cylindrical roll; and (c) means for reciprocally scrubbing said surface of said cylindrical roll with said at least one pivotable polishing block assembly, by reciprocally translating said at least one pivotable polishing block assembly across said surface of said cylindrical roll as said roll is rotating.

7. The apparatus of claim 6, wherein said abrasive pad comprises a moldable material selected from a group consisting of plastics, metals, and alloys.

8. The apparatus of claim 6, wherein said first end of said elongated arm is of rectangular cross-sectional shape to limit rotation of said block around said aligned longitudinal axes.

9. The apparatus of claim 6, wherein said abrasive pad includes a plurality of spaced-apart cut-outs, said cut-outs being generally parallel to said opposed ends.

10. The apparatus of claim 6, wherein said at least one pivotable polishing block assembly comprises a plurality of pivotable polishing block assemblies in tandem arrangement.

11. The apparatus of claim 6, wherein the exposed surface of said abrasive pad is arcuate in shape.

12. The apparatus of claim 8, wherein said at least one pivotable polishing block assembly comprises a plurality of pivotable polishing block assemblies in tandem arrangement.

13. The apparatus of claim 8, wherein said abrasive pad includes a plurality of spaced-apart cut-outs, said cut-outs being generally parallel to said opposed ends.

14. A pivotable polishing block assembly providing two degrees of rotational freedom for use with an apparatus for cleaning and polishing a peripheral surface of a cylindrical roll rotating about the longitudinal axis of the roll, the assembly comprising:

(a) a molded polishing block including an elongated abrasive pad support having a top surface, a bottom surface, opposed ends and opposed sides, a tang positioned on said top surface, said tang including a cut-out region adapted to receive a first rotatable bushing on one side of said tang and a second rotatable bushing on the other side of said tang, an abrasive pad located along said bottom surface, said abrasive pad composed of a moldable, abrasive material selected from a group consisting of metals, plastics and alloys and including an exposed arcuate surface of the moldable, abrasive material for cleaning and polishing the peripheral surface of the cylindrical roll, said abrasive pad having a plurality of spaced-apart cut-outs, said cut-outs being generally parallel to said opposed ends, said support having a plurality of openings communicating through said top surface and said bottom surface for receipt of a portion of said moldable, abrasive material thereby firmly attaching said abrasive pad to said support, said top surface, bottom surface, opposed ends and opposed sides of said elongated abrasive pad support being embedded in said moldable, abrasive material with said tang extending therefrom;

(b) an elongated arm having a first end and a second end region, said first end being adapted to matingly engage one end of a first shaft positioned through said first bushing, said cut-out region of said tang and said second bushing thereby holding said first bushing in contact with said first end and said tang and the other end of said first shaft having a head portion to hold said second bushing in contact with said tang whereby said bushings permit said block to rotate in a plane perpendicular to aligned longitudinal axes of said first shaft and said arm as the pivoting polishing block assembly is used during the cleaning and polishing of the rotating cylindrical roll, said first end being of rectangular cross-sectional shape to limit rotation of said block around said aligned axes, said second end region of said arm being provided with a bore therethrough, said bore being substantially perpendicular to the longitudinal axis of said arm, said bore including a resilient insert having a generally cylindrically-shaped channel therethrough and a tube extending through said channel and affixed thereto, the ends of said tube extending outwardly beyond the perimeter of said second region; and (c) mounting brackets having aligned cut-out regions, each of said brackets adjustably and securely engagable with respective ends of said tube whereby said arm is resiliently rotatable around the longitudinal axis of said tube, a second shaft extending through said tube and said aligned cut-out regions, said second shaft adapted for secure engagement with said brackets, said mounting brackets being adapted for mounting to a support associated with the roll cleaning and polishing apparatus.

15. An apparatus for cleaning and polishing a peripheral surface of a cylindrical roll rotating about the longitudinal axis of the roll, the apparatus comprising:

(a) a plurality of pivotable polishing block assemblies in tandem arrangement, each assembly providing two degrees of rotational freedom and wherein each assembly includes (i) a molded polishing block including an elongated abrasive pad support having a top surface, a bottom surface, opposed ends and opposed sides, a tang positioned on said top surface, said tang including a cut-out region adapted to receive a first rotatable bushing on one side of said tang and a second rotatable bushing on the other side of said tang, an abrasive pad located along said bottom surface, said abrasive pad composed of a moldable, abrasive material selected from a group consisting of metals, plastics and alloys and including an exposed arcuate surface of the moldable, abrasive material for cleaning and polishing the peripheral surface of the cylindrical roll, said abrasive pad having a plurality of spaced-apart cut-outs, said cut-outs being generally parallel to said opposed ends, said support having a plurality of openings communicating through said top surface and said bottom surface for receipt of a portion of said moldable, abrasive material thereby firmly attaching said abrasive pad to said support, said top surface, bottom surface, opposed ends and opposed sides of said elongated abrasive pad support being embedded in said moldable, abrasive material with said tang extending therefrom;

(ii) an elongated arm having a first end and a second end region, said first end being adapted to matingly engage one end of a first shaft positioned through said first bushing, said cut-out region of said tang and said second bushing thereby holding said first bushing in contact with said first end and said tang and the other end of said first shaft having a head portion to hold said second bushing in contact with said tang whereby said bushings permit said block to rotate in a plane perpendicular to aligned longitudinal axes of said first shaft and said arm as said each assembly is used during the cleaning and polishing of the rotating cylindrical roll, said first end being of rectangular cross-sectional shape to limit rotation of said block around said aligned axes, said second end region of said arm being provided with a bore therethrough, said bore being substantially perpendicular to the longitudinal axis of said arm, said bore including a resilient insert having a generally cylindrically-shaped channel therethrough and a tube extending through said channel and affixed thereto, the ends of said tube extending outwardly beyond the perimeter of said second region;

(iii) mounting brackets having aligned cut-out regions, each of said brackets adjustably and securely engagable with respective ends of said tube whereby said arm is resiliently rotatable around the longitudinal axis of said tube, a second shaft extending through said tube and said aligned cut-out regions, said second shaft adapted for secure engagement with said brackets, said mounting brackets being adapted for mounting to a support associated with the roll cleaning and polishing apparatus;

(b) means for positioning said polishing block assemblies in contact with said surface of said cylindrical roll; and (c) means for reciprocally scrubbing said surface of said cylindrical roll with said polishing block assemblies, by reciprocally translating said polishing block assemblies across said surface of said cylindrical roll as said roll is rotating.

16. The pivotable polishing block assembly of claim 2, wherein the moldable, abrasive material of the abrasive pad further includes a ground substance selected from a group consisting of sand, silicon, silicon carbide, and aluminum oxide.

17. The apparatus of claim 7, wherein the moldable, abrasive material of the abrasive pad further includes a ground substance selected from a group consisting of sand, silicon, silicon carbide, and aluminum oxide.

18. The pivotable polishing block assembly of claim 14, wherein the moldable, abrasive material of the abrasive pad further includes a ground substance selected from a group consisting of sand, silicon, silicon carbide, and aluminum oxide.

19. The apparatus of claim 15, wherein the moldable, abrasive material of the abrasive pad further includes a ground substance selected from a group consisting of sand, silicon, silicon carbide, and aluminum oxide.

20. A polishing block to be mounted on an apparatus for cleaning and polishing a peripheral surface of a cylindrical roll rotating about the longitudinal axis of the roll, the polishing block comprising:

(a) an elongated pad support having a top surface, a bottom surface, opposed ends and opposed sides, the pad support further having at least one opening formed therethrough extending between the bottom surface and the top surface;

(b) a tang positioned longitudinally on the top surface of the pad support, the tang including a cut-out region adapted to receive a connector from the apparatus for pivotal movement of the pad support in a plane parallel with the tang; and (c) an abrasive pad composed of a moldable, abrasive material located along the bottom surface of the pad support and formed such that the top surface, bottom surface, opposed ends and opposed sides of the pad support are embedded in the moldable, abrasive material with the tang extending therefrom, a portion of the moldable, abrasive material being received by the opening in the pad support to firmly attach the abrasive pad to the pad support, the abrasive pad further including an exposed surface of the moldable, abrasive material for cleaning and polishing the peripheral surface of the cylindrical roll.

21. The polishing block of claim 20, wherein the exposed surface of the abrasive pad includes a plurality of spaced-apart cut-outs formed therein.

22. The polishing block of claim 20, wherein the exposed surface of the abrasive pad is arcuate in shape.

23. The polishing block of claim 20, wherein the moldable, abrasive material of the abrasive pad is selected from a group consisting of plastics, metals, and alloys.

24. The polishing block of claim 23, wherein the moldable, abrasive material of the abrasive pad further includes a ground substance selected from a group consisting of sand, silicon, silicon carbide, and aluminum oxide.

* * * * *